US009388611B2

(12) United States Patent
Schuberth

(10) Patent No.: US 9,388,611 B2
(45) **Date of Patent: *Jul. 12, 2016**

(54) MULTI-POINT LOCK HAVING A FLUSH-MOUNT CYLINDER

(71) Applicant: Oliver Erich Rudolf Schuberth, Laas (DE)

(72) Inventor: Oliver Erich Rudolf Schuberth, Laas (DE)

(73) Assignee: HOPPE Holding AG, Müstair (CH)

( * ) Notice: Subject to any disclaimer, the term of this patent is extended or adjusted under 35 U.S.C. 154(b) by 161 days.

This patent is subject to a terminal disclaimer.

(21) Appl. No.: 13/713,152

(22) Filed: Dec. 13, 2012

(65) Prior Publication Data

US 2013/0167597 A1 Jul. 4, 2013

Related U.S. Application Data

(60) Provisional application No. 61/582,685, filed on Jan. 3, 2012.

(51) Int. Cl.

| | |
|---|---|
| ***E05C 9/04*** | (2006.01) |
| ***E05B 63/00*** | (2006.01) |
| ***E05B 9/08*** | (2006.01) |
| *E05C 9/18* | (2006.01) |
| *E05C 9/22* | (2006.01) |

(52) U.S. Cl.

CPC . *E05C 9/047* (2013.01); *E05B 9/08* (2013.01); *E05B 63/006* (2013.01); *E05C 9/185* (2013.01); *E05C 9/22* (2013.01); *Y10T 29/49826* (2015.01); *Y10T 70/5248* (2015.04)

(58) Field of Classification Search

CPC ..... E05C 9/047; E05C 9/026; E05C 19/001; E05C 9/008; E05C 9/1841; E05C 9/185; E05C 9/22; E05B 63/0021; E05B 63/08; E05B 65/087; E05B 63/006; Y10S 292/60; Y10T 29/49826; Y10T 70/5248

USPC ..... 70/104, 107–110; 292/32, 34–37, 41, 292/150, 157

See application file for complete search history.

(56) References Cited

U.S. PATENT DOCUMENTS

| | | | | | |
|---|---|---|---|---|---|
| 3,578,369 | A | * | 5/1971 | Coopersmith | 292/58 |
| 4,071,270 | A | * | 1/1978 | Alexander | 292/169.22 |
| 4,156,541 | A | * | 5/1979 | Babb, Jr. | E05C 9/025 292/21 |
| 5,290,077 | A | * | 3/1994 | Fleming | 292/35 |
| 5,350,207 | A | * | 9/1994 | Sanders | 292/335 |
| 5,373,716 | A | * | 12/1994 | MacNeil et al. | 70/109 |
| 5,388,875 | A | * | 2/1995 | Fleming | 292/37 |
| 5,457,975 | A | * | 10/1995 | Berger | E05B 9/084 70/370 |
| 5,524,941 | A | * | 6/1996 | Fleming | 292/34 |
| 5,524,942 | A | * | 6/1996 | Fleming | 292/34 |
| 5,782,114 | A | | 7/1998 | Zeus et al. | |

(Continued)

*Primary Examiner* — Suzanne Barrett

(74) *Attorney, Agent, or Firm* — Reinhart Boerner Van Deuren P.C.

(57) ABSTRACT

A multi-point lock having an easy to install modular drive mechanism for bolts located at the top and bottom edges of a door in which the multi-point locking system is installed that requires only relatively simple door preparation. The bolt operating mechanism is installed into a rectangular groove cut into a lateral edge of a door which may be cut using relatively simple tools in relatively quick fashion. The multi-point lock is configured to fit doors of any size, with a single kit accommodating doors of different thicknesses, in each case, with the plug-face of the lock cylinder substantially flush with a major face of a backplate of a handle set used with a particular door.

21 Claims, 9 Drawing Sheets

(56) References Cited

U.S. PATENT DOCUMENTS 5,992,195 A * 11/1999 Huang ..... E05B 13/005 292/169.22
6,209,931 B1 4/2001 Von Stoutenborough et al.
7,421,868 B2 * 9/2008 Matyko et al. ..... 70/120
7,475,578 B2 * 1/2009 Brown et al. ..... 70/451
7,513,539 B2 * 4/2009 Phipps ..... 292/36
7,543,860 B2 * 6/2009 Meeks et al. ..... 292/137
7,707,862 B2 * 5/2010 Walls et al. ..... 70/107
7,753,418 B2 * 7/2010 Fleming ..... 292/336.3
8,157,299 B2 * 4/2012 Mitchell et al. ..... 292/32
8,161,780 B1 * 4/2012 Huml ..... E05B 15/02 292/142
8,267,442 B2 * 9/2012 Tien ..... E05B 3/00 292/138
8,881,562 B2 * 11/2014 Huang ..... E05B 17/2084 70/107
2002/0053227 A1 * 5/2002 Chiang ..... E05B 47/0692 70/107
2003/0070455 A1 * 4/2003 Huang ..... E05B 59/00 70/107
2005/0229656 A1 * 10/2005 Brown et al. ..... 70/107
2007/0084258 A1 * 4/2007 Matyko et al. ..... 70/120
2007/0101777 A1 * 5/2007 Shen ..... E05B 15/02 70/107
2008/0150300 A1 * 6/2008 Harger et al. ..... 292/32
2009/0193860 A1 * 8/2009 Meekma ..... 70/109
2011/0314878 A1 * 12/2011 Roth ..... E05B 47/02 70/107
2012/0049540 A1 * 3/2012 Taylor et al. ..... 292/157
2012/0049541 A1 3/2012 Taylor et al.
2012/0198896 A1 * 8/2012 Moon ..... 70/145
2013/0000364 A1 * 1/2013 Huang et al. ..... 70/107
2014/0109635 A1 * 4/2014 Chang et al. ..... 70/357

* cited by examiner

MULTI-POINT LOCK HAVING A FLUSH-MOUNT CYLINDER

CROSS-REFERENCE TO RELATED PATENT APPLICATIONS

This patent application claims priority of U.S. Provisional Patent Application No. 61/582,685, filed Jan. 3, 2012, entitled "Multi-Point Lock Having A Flush-Mount Cylinder," which is entitled "Multi-Point Lock Having A Flush-Mount Cylinder," which patent application is hereby incorporated herein by reference in its entirety.

BACKGROUND OF THE INVENTION

Field of the Invention

The present invention relates generally to multi-point locking systems, and more particularly to a multi-point lock having an easy to install modular drive mechanism for shootbolts located at one of the top, bottom, lateral edges of a door with a cylinder mounted substantially flush with a major face of a backplate of a handle set.

Simple locks have a mortise unit mounted adjacent the edge of a door with a latch and, optionally, a deadbolt that extend from the mortise unit into a latch plate mounted in the door frame into which the door is installed. An increased level of security is afforded by multi-point door locks to provide more secure closure and locking. Typical conventional multi-point door locks have more than one latch or bolt that engages the door frame or adjacent panel, for example a French door. Multiple bolts are substantially more difficult to overcome in a forcible entry than a single deadbolt and latch, and facilitates enhanced weather sealing.

For example, instead of the conventional single latch and deadbolt extending from the mortise unit, three bolts and a latch may be used. A first deadbolt and latch engage with the door frame (or with a second door) that is locked into the closed position. A second bolt and a third bolt are respectively mounted at the top and bottom edges of the door above and below the mortise unit respectively to engage the upper and lower portions of the door frame, respectively. The second and third bolts, referred to as bolts, for example, shootbolts, tonguebolt, roundbolt, rollerbolt, swingbolt, and hookbolt, are also controlled by the mortise unit, and operate simultaneously with the deadbolt extending from the mortise unit. Examples of such multi-point locks may be found, for example, in U.S. Pat. No. 5,782,114, to Zeus et al., and in U.S. Pat. No. 6,209,931, to Von Stoutenborough at al., both of which are hereby incorporated herein.

Existing multi-point locks require extensive and complex preparation of the door to install the shootbolts of a conventional multi-point lock, including, for example, the installation of a square hole from the top to the bottom of the door to allow the installation of the shootbolts at the top and bottom edges of the door. Further, once installed, such conventional multi-point locks typically require the removal of the door in order to remove the lock from the door. It will be appreciated that such conventional multi-point locks are complex and expensive to install into a door, and that fairly complex and precise equipment is required in order to install such conventional multi-point locks into a door.

It is also known in a multi-point locking system that a keyed cylinder is typically utilized to lock and unlock the multi-point locking system. One such method is to utilize a Euro-profile or "profile cylinder." A profile cylinder typically is inserted through a handle set and mortise lock of the multi-point lock assembly and fixed to the lock with a cylinder screw. The cylinder screw is inserted into the mortise unit at a right angle to the profile cylinder and secured to the profile cylinder to lock it in place. Utilizing the profile cylinder requires that the cylinder be sized according to the thickness of the door and the relative position of the mortise lock case within the door. As a result, a plurality of Euro-profile cylinders must be maintained to accommodate the many variations in terms of size of (thickness) doors to which such systems are installed.

It is also known that the keyed cylinder of a multi-point locking system can utilize a "tail piece" cylinder also known as a "US-style" cylinder. In a typical installation of a US-style cylinder an additional housing feature associated with the exterior backplate is utilized to accommodate the fixing of the tail piece cylinder to the multi-point locking system. In a typical installation such housing is a feature that stands proud (extends above) of the major face of the backplate of the handle set. Such housing, can be a formed feature as part of the backplate or as an added component. In a typical configuration, such housing extends at least one-quarter of an inch above the backplate. Either such arrangement typically is undesirable as it adds cost to the handle set because of additional material and also creates a complex finishing procedure.

It is accordingly desirable that the present invention provide an easy installation of a multi-point lock into a door, not requiring a complex installation process. It is also desirable that the multi-point lock of the present invention be installable in a door using only relative simple tools to prepare the door for installation of the bolt and its bolt actuating mechanism. It is additionally desirable of the multi-point lock of the present invention that the bolt and its bolt actuating mechanism be of relatively simple mechanical construction to further facilitate their installation into a door. It is further desirable of the multi-point lock of the present invention that the plug-face of the cylinder be substantially flush with the major face of the back plate of a handle set without an additional external housing.

It is desirable that the multi-point lock and/or the mortise unit be removable from a door without requiring the door to be removed. It is also desirable that the multi-point lock of the present invention be of modular construction to facilitate both the installation as well as the removal of the multi-point lock of the present device. It is further desirable that the multi-point lock of the present invention be adaptable to fit doors of any size, preferably in a single kit which accommodates doors of different sizes.

The multi-point lock of the present invention must also be of construction which is both durable and long lasting, and it should also require little or no maintenance to be provided by the user throughout its operating lifetime. In order to enhance the market appeal of multi-point lock of the present invention, it should also be of inexpensive construction to thereby afford it the broadest possible market. Finally, it is also desirable that all of the aforesaid advantages be achieved by multi-point lock of the present invention without incurring any substantial relative disadvantage.

The subject matter discussed in this background of the invention section should not be assumed to be prior art merely as a result of its mention in the background. Similarly, a problem mentioned in the background section or associated with the subject matter of the background of the invention section should not be assumed to have been previously recognized in the prior art. The subject matter in the background section merely represents different approaches, which in and of themselves may also be inventions.

SUMMARY OF THE INVENTION

The disadvantages and limitations of the background art discussed above are overcome by the present invention. With this invention, the mortise lock, two bolt assemblies, and two bolt actuating mechanisms are provided which are of modular construction. The bolt operating mechanism is installed into a rectangular groove cut into a lateral edge of a door which may be cut using relatively simple tools, for example a router, in relatively quick fashion, or installed in a cavity defined in the door. A pocket for the mortise unit is cut into the lateral edge of the door as is conventional. Housings for the bolt assemblies are installed into cylindrical apertures drilled into the top and bottom edges of the door adjacent to and in communication with the groove cut in the lateral edge of the door or in the cavity.

In one exemplary embodiment, the bolt actuating mechanisms consist of a driverail slidably mounted in a groove, entirely within the groove defined is the lateral edge of the door above and below the mortise pocket. A distal end of each of the driverails is attached to a bolt by pushing the distal end of the driverail through a shootbolt housing, attaching the driverail to the bolt, and retracting the bolt into the shootbolt housing with the driverail. A proximal end of each of the driverails has an engagement mechanism located thereupon for engagement by the mortise unit.

The mortise unit has mating engagement mechanisms locate on the top and bottom sides thereof. As the mortise unit is slid into the mortise pocket in the door, the mating engagement mechanism on the top of the mortise unit will drivingly engage the proximal end of the driverail operating the bolt located in the top edge of the door, and the mating engagement mechanism on the bottom of the mortise unit will drivingly engage the proximal end of the driverail operating the bolt located in the bottom edge of the door. It will thus be appreciated that the mortise unit may be configured to open and close a deadbolt extending laterally from the mortise unit as well as the bolts located at the top and bottom of the door.

The mortise unit defines an orifice through the unit. The orifice is configured to slidingly receive an input hub and allow selective lateral movement of the input hub within the orifice. The multi-point lock includes a cylinder assembly. The cylinder assembly includes a cylinder having a cylinder tail piece at one end with a plug-face at another end, and an underplate housing. The underplate housing is configured to receive the cylinder and align the cylinder in the orifice with the plug-face substantially flush with a backplate in a handle set. The position of the cylinder relative to the mortise unit and the major face of the backplate of a handle set is facilitated by the input hub sliding within the mortise unit. The cylinder may also define a key-lock opening in the plug-face of the cylinder. The shootbolt is driven from said retracted position to said extended position when said driving element of said mortise unit is moved from said unlocked position to said locked position.

A thin cap or filler piece may be mounted on the lateral edge of the door to visually conceal the groove and the driverails. The housings for the shootbolt assemblies may have different mounting plates having different numbers of apertures for receiving mounting screws that are screwed onto the top or the bottom of the door. The shootbolts may be of either cylindrical, square, or other geometric configurations, as desired. U-shaped channels of the shootbolt actuating mechanisms may optionally be mounted in the groove in the lateral edge of the door with mounting hardware such as screws. Alternately, the tops of the legs of the U-shaped channels may have barbed edges and the groove may have receiving deeper recesses along the sides thereof to receive the Barbed-edge legs of the U-shaped channels to retain the U-shaped channels in the groove once so installed.

There is further provided a multi-point lock including a plurality of driverails and associated bolts, with the multi-point lock configured for installation in the door. A cylinder of the multi-point lock includes a plug-face disposed substantially flush with a backplate of a handle set associated with the multi-point lock. The mortise unit of the multi-point lock is configured for installation into the lateral edge of the door with the mortise unit having a drive element associate therewith that is movable between an unlocked and a locked position. The driving element is engaging at least one driverail when said mortise unit is installed into the lateral edge of the door after said driverail has been installed into the door. The mortise unit further defines an orifice through the unit. The orifice is configured to slidingly receive an input hub and allow selective lateral movement of the input hub within the orifice.

A cylinder assembly is associated with the multi-point lock. The cylinder assembly includes a cylinder having a cylinder tail piece at one end with a plug-face at another end. The cylinder assembly further includes an underplate housing, with the underplate housing configured to receive the cylinder and align the cylinder in the orifice defined in the mortise unit. When installed in the multi-point lock, the cylinder plug-face is substantially flush with the backplate in the handle set. The cylinder assembly can be utilized with a range of door thicknesses. The positioning of the cylinder in the orifice is facilitated by the input hub sliding within the mortise unit. In operation the bolt is driven from a retracted position to an extended position when the driving element of the mortise unit is moved from the unlocked position to the locked position.

There is additionally provided a method of installing a multi-point lock into a door. The method includes mounting at least one shootbolt in one of a top and bottom edge of the door. Installing at least one driverail into a groove defined in a lateral edge of the door, with the driverail having proximate and distal opposite ends. The driverail is in the groove in a vertically slidable manner with the distal end of the driverail coupled to the shootbolt to drive the shootbolt between a retracted position and an extended position. The driverail includes an engagement element located at the proximal end thereof.

The method further includes installing a mortise unit into the lateral edge of the door after said driverail has been installed into the groove. The mortise unit has a driving element associated therewith that is movable between an unlocked and locked positions with the driving element engaging said engagement element in said driverail. The mortise unit defines an orifice through the unit. The orifice is configured to slidingly receive an input hub and allow selective lateral movement of the input hub within the orifice. A cylinder assembly is installed into the mortise unit. The cylinder assembly includes a cylinder having a cylinder tail piece at one end with a plug-face at another end. The cylinder assembly includes an underplate housing with the underplate housing configured to receive the cylinder and align the cylinder in the orifice with the plug-face substantially flush with a backplate in a handle set. The position of the cylinder is facilitated by the input hub sliding within the mortise unit. In operation, when the shootbolt is driven from said retracted position to said extended position to lock a door, when the driving element of the mortise unit is moved from the unlocked position to a locked position.

It may therefore be seen that the present invention teaches a multi-point lock having a shootbolt actuating mechanism that is easy to install in a door, and which does not require a complex installation process. The multi-point lock of the present invention has a bolt and a bolt actuating mechanism that are installable in a door using only relative simple tools to prepare the door for installation of the bolt and its bolt actuating mechanism. The bolt and its bolt actuating mechanism are of relatively simple mechanical construction to further facilitate their installation into a door.

The multi-point lock and/or the mortise unit of the present invention is removable from a door without requiring the door to be removed. It is of modular construction to facilitate both the installation as well as the removal of the multi-point lock of the present invention. The multi-point lock of the present invention is adaptable to fit doors of any size, with a single kit accommodating doors of different sizes, in each case, with the plug-face of the cylinder substantially flush with a major face of a backplate of a handle set used with a particular door.

The multi-point lock of the present invention is of a construction which is both durable and long lasting, and which will require little or no maintenance to be provided by the user throughout its operating lifetime. The multi-point lock of the present invention is also of inexpensive construction to enhance its market appeal and to thereby afford it the broadest possible market. Finally, all of the aforesaid advantages are achieved by the multi-point lock of the present invention without incurring any substantial relative disadvantage.

DESCRIPTION OF THE DRAWINGS

These and other advantages of the present invention are best understood with reference to the drawings, in which.

DETAILED DESCRIPTION OF THE EXEMPLARY EMBODIMENT

Figure 1:
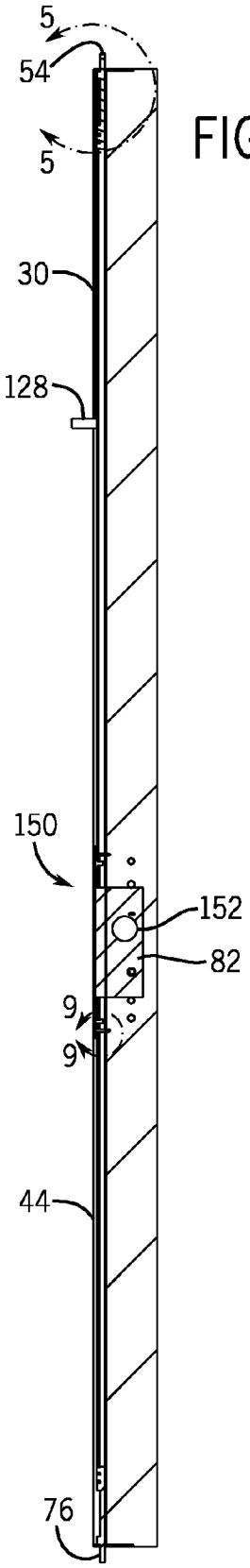
FIG. 1 is a somewhat schematic cross-sectional view of a portion of the closing edge of a door showing a dado into which the U-shaped channels and shootbolt actuating driverails of the present invention are installed respectively located at the top and bottom of the door.
Figure 2:
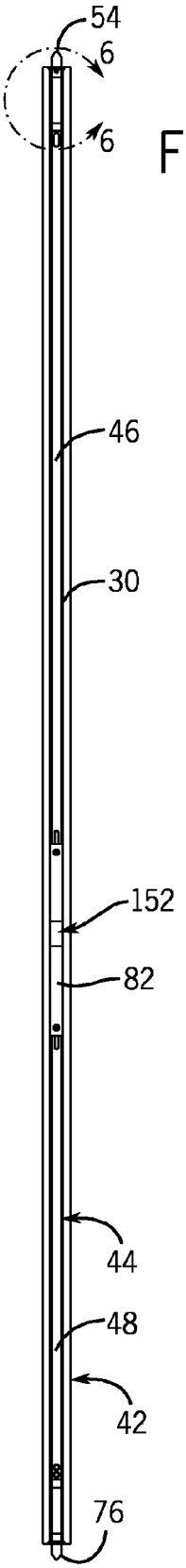
FIG. 2 is a side view of the U-shaped channels and shootbolt actuating driverails illustrated in FIG. 1 and the shootbolt assemblies to which they are respectively connected.
Figure 3:
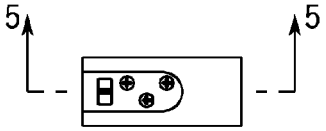
FIG. 3 is a top plan view of the top edge of the door illustrated on FIG. 1 showing one of the shootbolt assemblies which is mounted therein.

The descriptions herein are directed to multi-point locks using bolts referred to as shootbolts extending from one of the top edge and bottom edge of a door, and more typically from both the top and bottom edges of the door. It should be understood that the term "bolt" as used herein in a multi-point lock is not an elongated fastener having a threaded portion and a head. As used herein, a "bolt" is a component of a multi-point lock that extends from a locking device installed in a top, bottom, and lateral edge of a door or window to engaged and secure the door or window to its frame or to another adjacent member, i.e. a French door unit.

It should also be understood that a bolt used in a multi-point lock may also be a shootbolt, tongue bolt, roundbolt, rollerbolt, swingbolt, and a hookbolt. Also, a multi-point lock can be configured to include bolts extending from a lateral edge of a door in addition to the top and bottom edge of the door, for example a 3 or 4 bolt multi-point lock. Multi-point lock systems, with and without channels, in doors and windows, are taught in U.S. patent application Ser. Nos. 13/219,142 and 13/219,196, both filed on Aug. 26, 2011, both of which are assigned to the assignee of the present patent application, and both of which are herein incorporated by this reference.

The preferred embodiment of the multi-point lock of the present invention is shown in FIGS. 1 through 10, 13-15, and includes five primary components: a mortise unit for installation into the lateral edge of a door with the mortise unit configured to receive a cylinder assembly adapted for a range of door thicknesses, two shootbolt assemblies for installation into the top and bottom edges of the door adjacent to the lateral edge thereof or a cavity defined in the door parallel to a lateral edge of the door, and two shootbolt actuating mechanisms for installation into a rectangular groove cut into the lateral edge of the door or the above defined cavity. The primary focus of the invention, however, is on the drive mechanisms with a cylinder mounted substantially flush with a major face of a backplate of a handle set.

The multi-point lock 150 of the present invention is configured for installation into the lateral edge 42 of a door. (See FIGS. 1 and 2) The multi-point lock 150 includes a mortise unit 82. The mortise unit includes the drive elements and mechanisms for moving the shootbolts and driverails as more fully described below. The mortise unit 82 defines an orifice 152. The orifice 152 is a through-hole extending throughout the thickness of the mortise unit. The orifice 152 is configured to slidingly receive an input hub 176 and to allow the input hub 176 to selectively move laterally within the orifice 152. The orifice 152 may include notches or grooves to facilitate retention of the input hub 176 within the orifice 152. The input hub 176 is configured with corresponding notches or grooves to assist in retention of the input hub 176 within the orifice 152. The input hub 176 is also configured with a central bore configured to receive a cylinder tail piece 168 associated with the cylinder assembly 160 described below.

Figure 13:
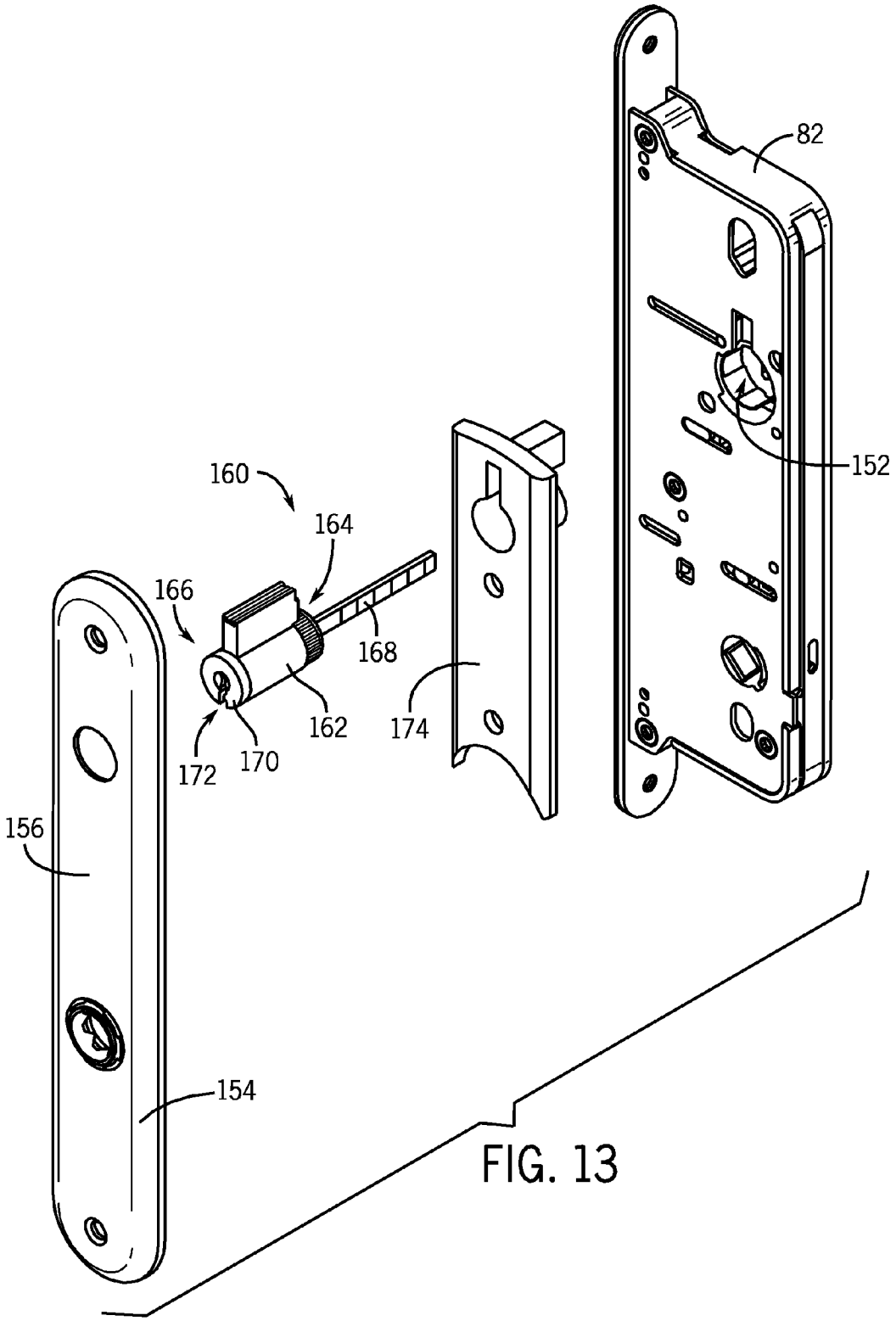
FIG. 13 is an exploded perspective view of a an exemplary embodiment of a mortise unit illustrated in FIG. 1, with a cylinder assembly aligned with an orifice, the orifice containing an input hub defined in the mortise unit and aligned with a backplate of a handle set.
Figure 14:
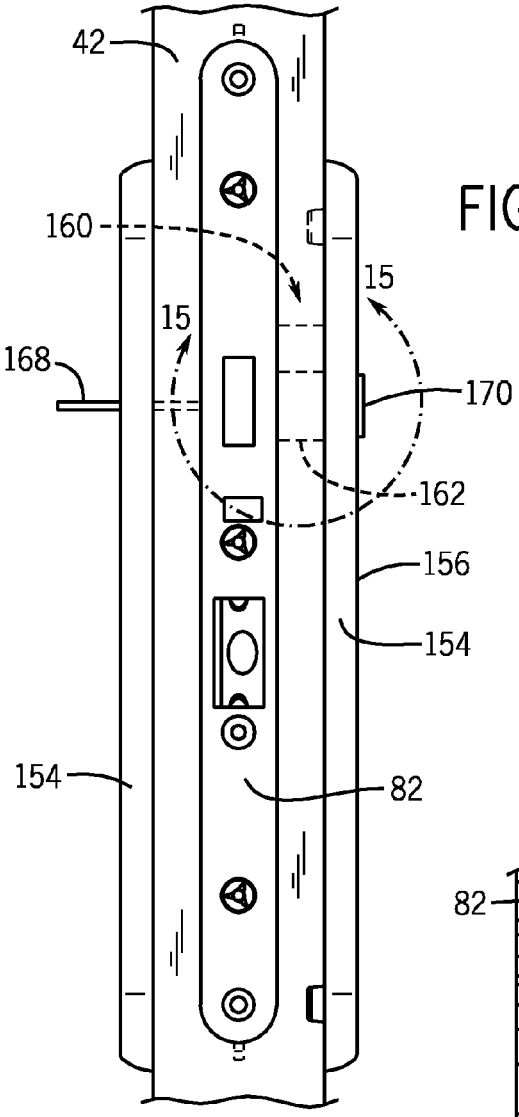
FIG. 14 is an end view of the mortise unit, cylinder assembly and handle set backplates installed in a lateral edge of a door.
Figure 15:
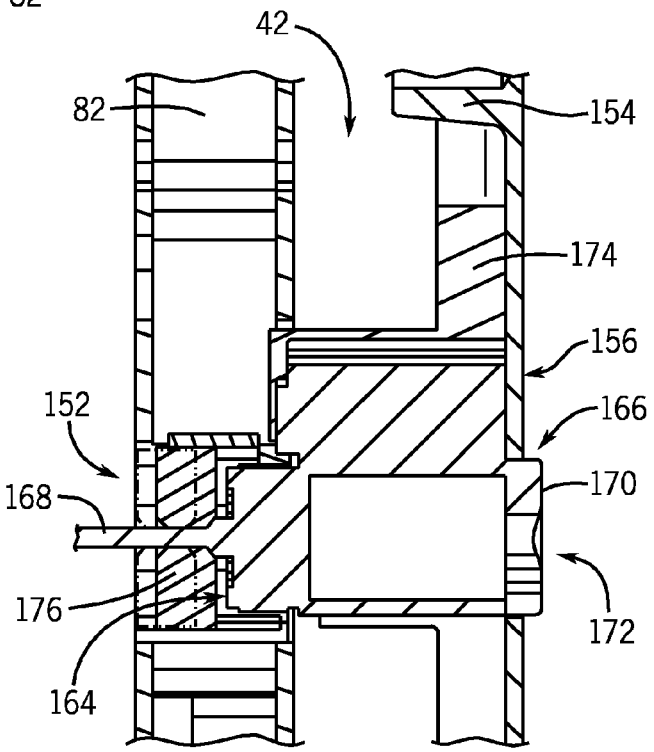
FIG. 15 is a detail view of the cylinder assembly illustrated in FIG. 14 along the line 15-15.

Referring to FIGS. 13-15, the cylinder assembly 160 includes a cylinder 162 having a cylinder tail piece 168 at one end 164 with a plug-face 170 at another end 166. The cylinder assembly 160 also includes an underplate housing 174. The underplate housing 174 is configured to receive the cylinder 162 and align the cylinder 162 in the orifice 152 with the cylinder plug-face 170 substantially flush with a major face 156 of a backplate 154 in the handle set. The cylinder assembly 160 is configured for use in a range of door thicknesses wherein the position of the cylinder 162 in the orifice 152 is facilitated by the input hub 176 sliding within the mortise unit 82. For purposes of this application, the phrase "substantially flush with a backplate" shall mean that the plug-face 170 of the cylinder 162 does not extend more than one-eighth of an inch beyond the major face 156 of a backplate 154. The present cylinder assembly 160, in contrast to prior art, does not require an additional housing, either separate or integral with a backplate to enclose the cylinder of a key-lock. Such housing, in prior art, typically extends at least one-fourth of an inch from a major face of a backplate thereby adding manufacturing and material costs to a specific lock assembly and is not flush with the backplate.

The present multi-point lock 150 with the disclosed cylinder assembly 160 is configured such that the cylinder plug-face 170 is substantially flush with the major face 156 of the backplate 154 of a handle set as described above. The cylinder plug-face 170 can be plain or can define a key-lock opening 172. In the later configuration, the cylinder 162 includes lock pins and springs, or similar devices to lock the multi-point lock 150. The key-lock opening 172 allows a key to operate the lock mechanism. The cylinder assembly 160 is adaptable for a range of door thicknesses such that the same cylinder assembly 160 can be used with any door thickness within a specific range.

In contrast, as described above, prior art cylinder assemblies, each door thickness requires a specific sized cylinder assembly (Euro-profile cylinder) or an extended housing to accommodate a US-style cylinder. The present multi-point lock 150 utilizes just one sized cylinder assembly 160 for the range of thicknesses for which it is designed. This unique cylinder assembly 160 accomplishes the above-described ability by the use of the input hub 176 slidable within the orifice 152. (See FIG. 15) The slidable input hub 176 allows the cylinder 162 to protrude into either side of the mortise lock orifice 152 defined in the mortise unit 82. The underplate housing constrains the cylinder 162 and aligns the cylinder 162 behind the backplate 154. (See FIG. 14).

It should be understood that a "range of door thicknesses" can be any range established by the manufacturer of the multi-point lock 150 disclosed herein in conjunction with the door manufacturer. For example, a range of door thicknesses can be from one inch to two and one-half inches with the nominal door thickness being one and three-quarters inches. As disclosed, the same size cylinder assembly 160 can be used with a door that is one inch thick, one and three-quarter inches thick, or two inches thick, in each case the plug-face 170 of the cylinder 162 being substantially flush with the major face 156 of the backplate 154 of the handle set.

Figure 4:
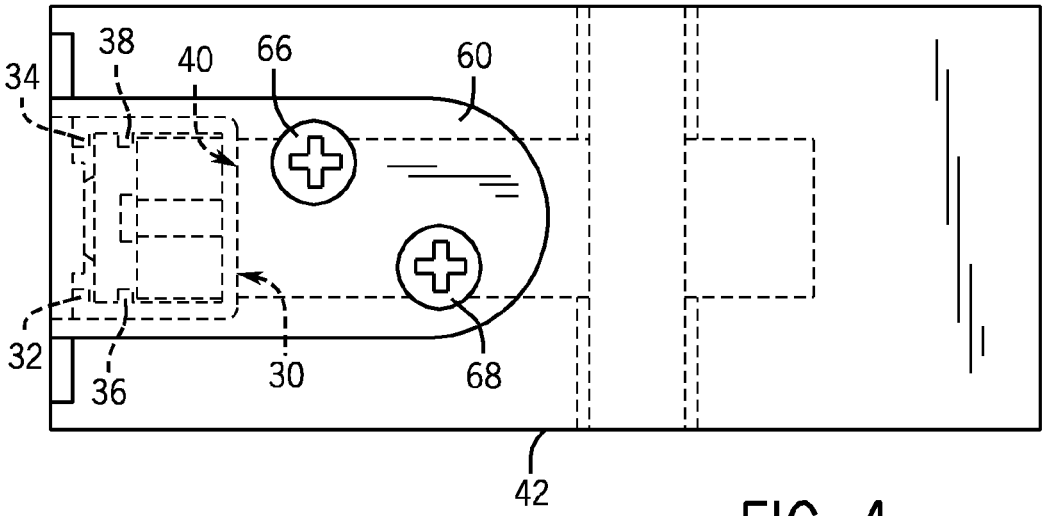
FIG. 4 is an enlarged top plan view of the shootbolt assembly illustrated in FIG. 3.
Figure 11:
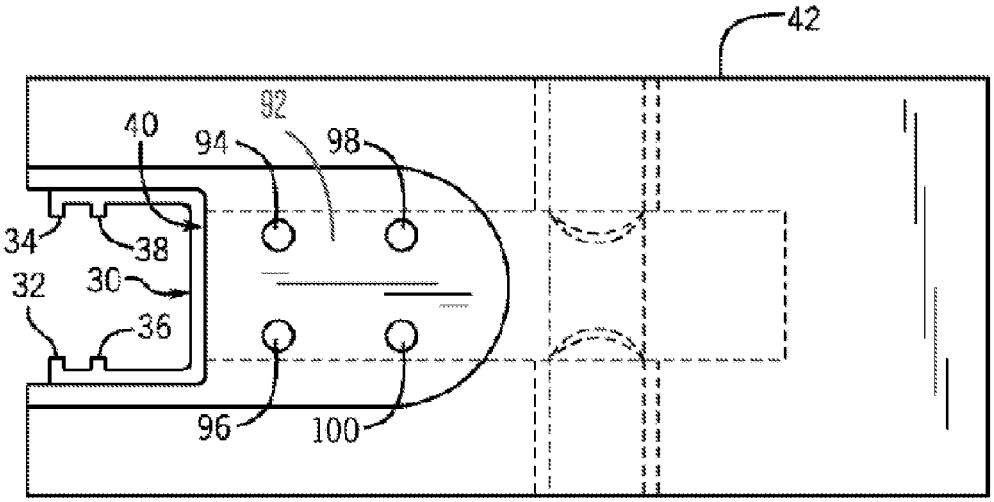
FIG. 11 is a top plan schematic view showing the alignment between the shootbolt assembly, the shootbolt actuating driverail, and the mortise unit.

The cross-sectional configuration of a U-shaped channel 30 is best shown in FIGS. 4 and 11 to be formed of a rectangular U-shape having a first opposed pair of inwardly-extending flanges 32 and 34 respectively located at the tops of the legs, and a second opposed pair of inwardly-extending flanges 36 and 38 respectively located on the legs of the U-shaped channel 30 spaced away from the first opposed pair of inwardly-extending flanges 32 and 34. The U-shaped channel 30 is located in a rectangular groove 40 cut into the lateral edge of the door 42 in the upper portion thereof. A second U-shaped channel 44 is located in the groove 40 in the lateral edge of the door 42 in the lower portion thereof.

A driverail 46 configured with a flat, rectangular cross-section is located in the U-shaped channel 30 intermediate the first opposed pair of inwardly-extending flanges 32 and 34 and the second opposed pair of inwardly-extending flanges 36 and 38. Similarly, a flat driverail 48 is located in the U-shaped channel 44 intermediate the opposed pairs of inwardly-extending flanges. The driverails 46 and 48 are slidably installed in the U-shaped channels 30 and 44, respectively. It should be understood that the cross-section shape of the drive rail 46, 48 may be other than rectangular, for example a driverail may have a circular cross-section.

A shootbolt 54 is slidably located in the portion of the U-shaped channel 30 intermediate the second opposed pair of inwardly-extending flanges 36 and 38 and the bottom of the "U." The shootbolt 54 has a pin 56 extending laterally therefrom into the area intermediate the first opposed pair of inwardly-extending flanges 32 and 34 and the second opposed pair of inwardly-extending flanges 36 and 38 where the driverail 46 is located.

The shootbolt 54 is retained in the U-shaped channel 30 by a mounting plate 60 located at the top thereof with a pair of apertures 62 and 64 located therein. The mounting plate 60 is installed onto the top edge of the door 42, and is retained in place with a pair of screws 66 and 68 which extend through the apertures 62 and 64 in the mounting plate 60, respectively, into the top edge of the door 42.

Figure 5:
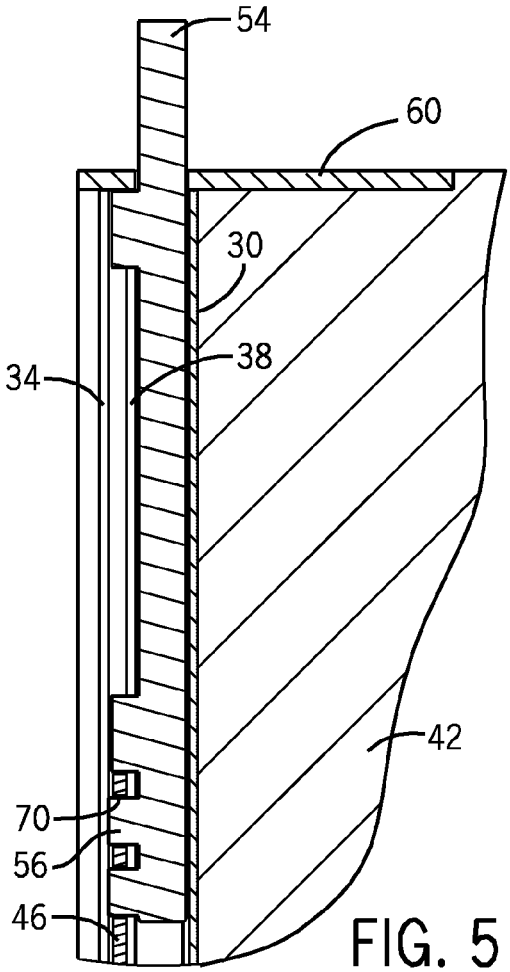
FIG. 5 is a cross-sectional view of the shootbolt assembly illustrated in FIGS. 3 and 4.
Figure 5B:
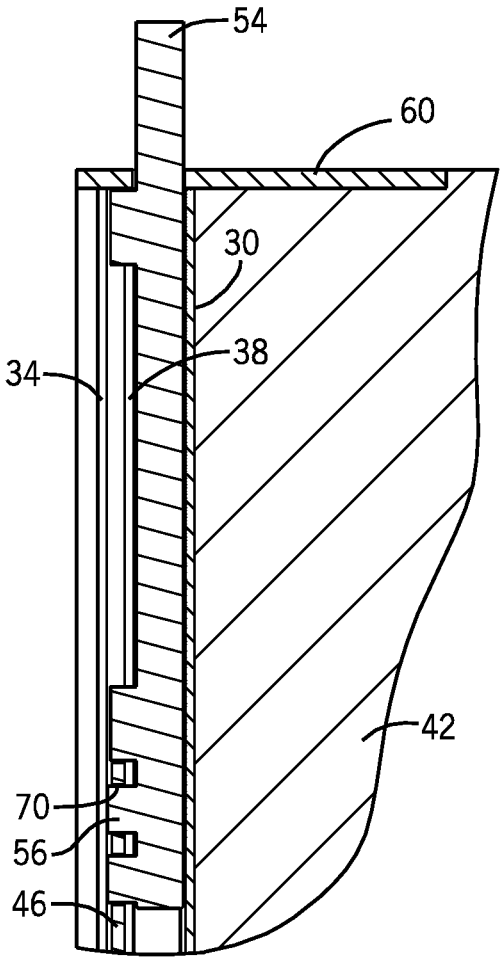
FIG. 5B is a cross-sectional view of a shootbolt assembly similar to that of FIG. 5 but having the driverail and a shootbolt as a single integral member having a driverail portion and a shootbolt portion.
Figure 6:
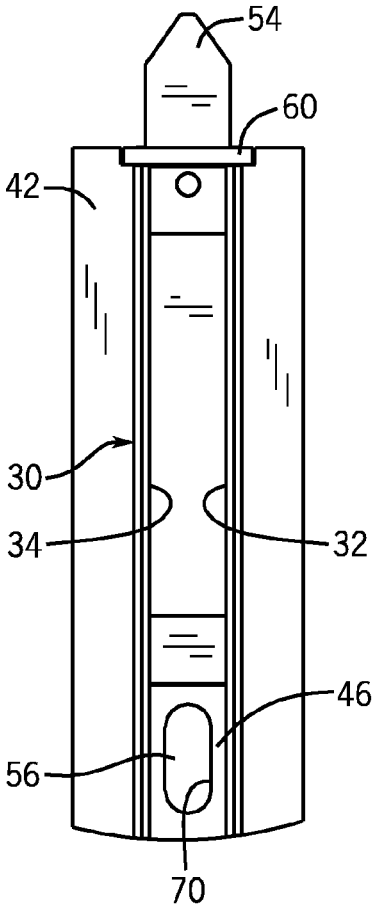
FIG. 6 is a lateral side view of the shootbolt assembly illustrated in FIGS. 3 through 5.
Figure 7:
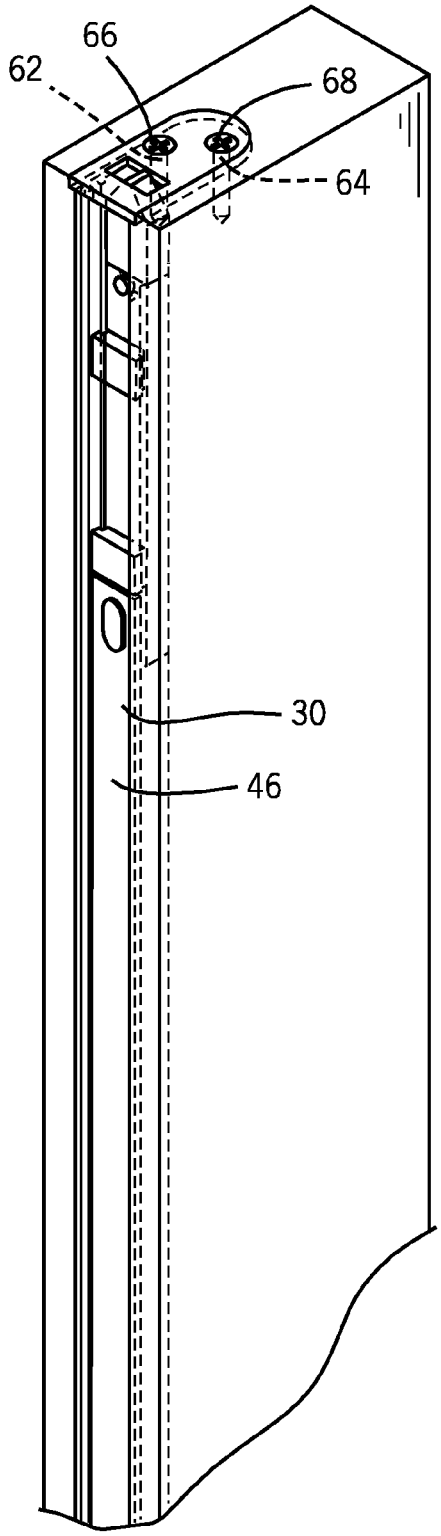
FIG. 7 is an isometric view of the shootbolt assembly illustrated in FIGS. 3 through 6 and the U-shaped channel and shootbolt actuating driverail attached thereto, with the door shown in phantom lines.
Figure 8:
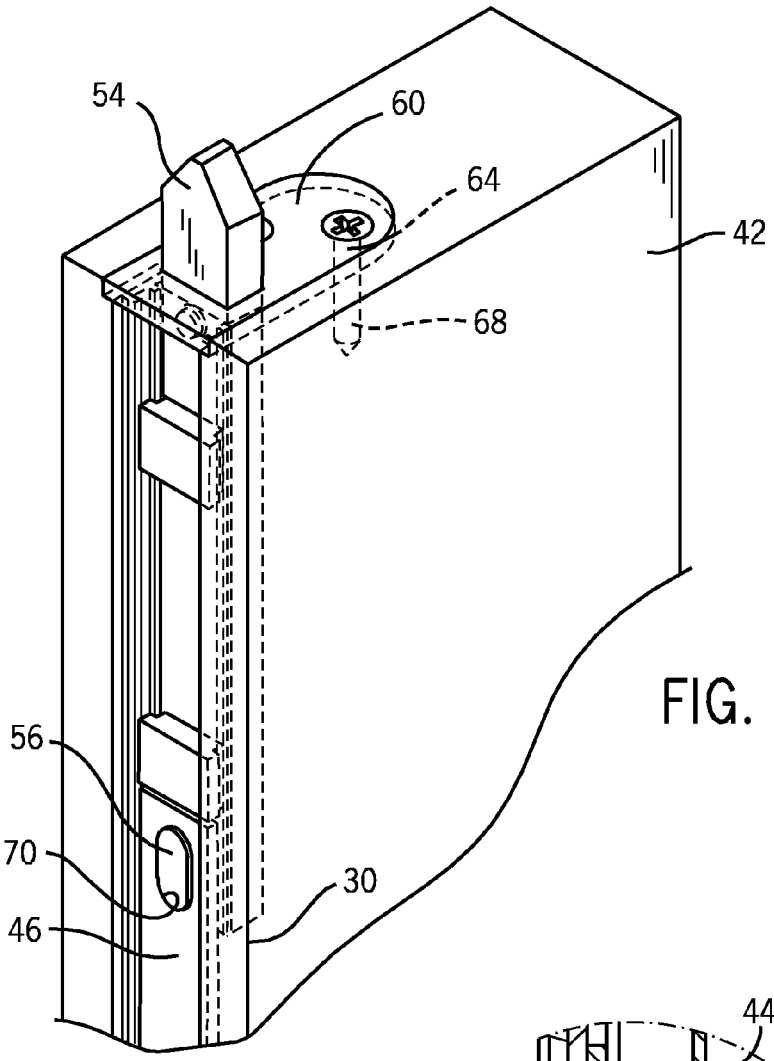
FIG. 8 is an isometric view of the shootbolt assembly illustrated in FIGS. 3 through 7, with the door shown in phantom lines.
Figure 9:
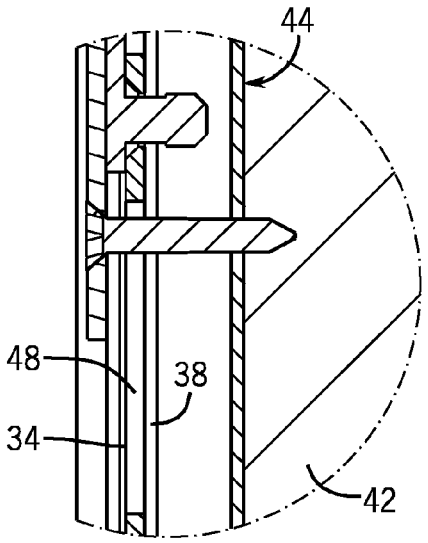
FIG. 9 is a cross-sectional view showing the interconnection between the mechanism used by the mortise unit to drive the shootbolt actuating driverails.

The driverail 46 has a mating aperture 70 located therein at its distal end thereof, which engages the pin 56 on the shootbolt 54. The distal end of the driverail 46 may be extended in the U-shaped channel 30 out of its top end, facilitating the shootbolt 54 being mounted onto the driverail 46 by inserting the pin 56 in the shootbolt 54 into the mating aperture 70 on the driverail 46. The driverail 46 may then retracted, pulling the shootbolt 54 into the interior of the U-shaped channel 30. In another embodiment the driverail 46 and shootbolt 54 are a single integral member, with a driverail portion and a shootbolt portion (see FIG. 5B). A shootbolt 76 which is configured similarly to the shootbolt 54 and which extends from the U-shaped channel 44 is located in the bottom edge of the door 42, and the driverail 48 is configured similarly to the driverail 46 to facilitate mounting the distal end of the driverail 48 to the shootbolt 76.

Figure 10:
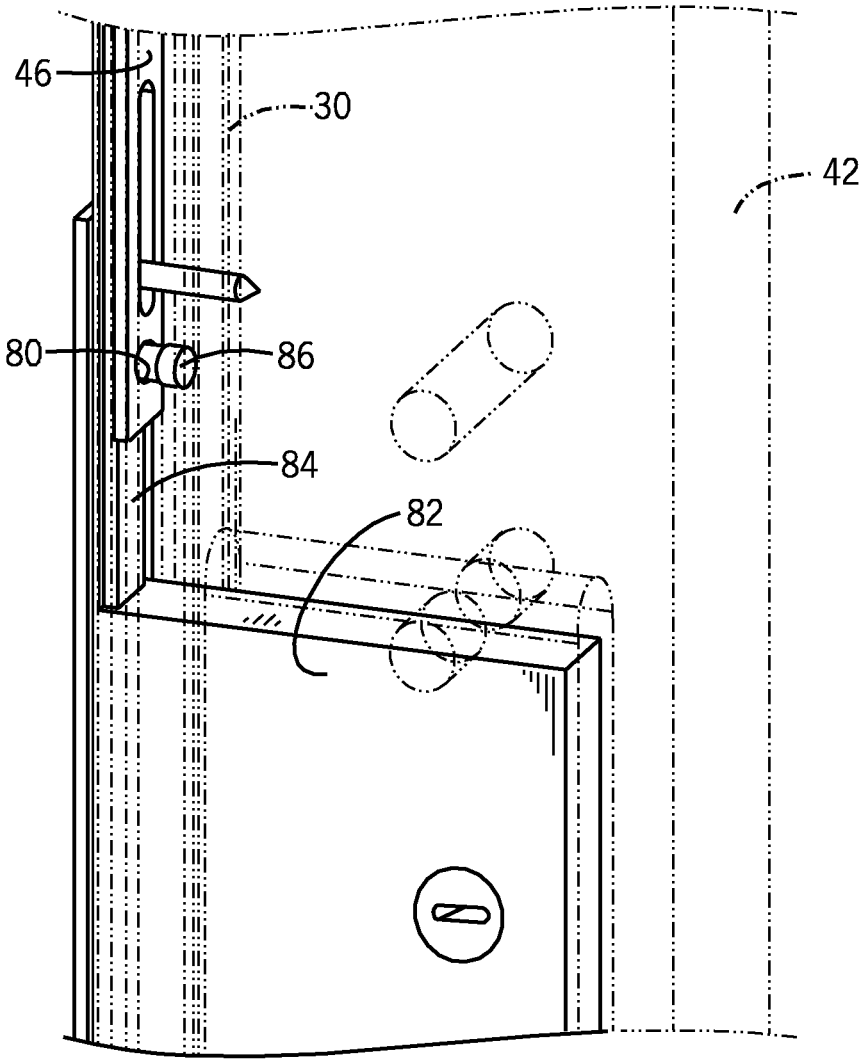
FIG. 10 is an isometric view of a portion of the door having the mortise unit mounted therein, showing the mechanism used by the mortise unit to drive the shootbolt actuating driverails, with the door shown in phantom lines.

The driverail 46 has an aperture 80 located near its proximal end thereof, as best shown in FIG. 10. A mortise unit 82 will be installed into the door 42 below the proximal end of the driverail 46. Extending from the top side of the mortise unit 82 is a reciprocally operable drive arm 84 which has an inwardly extending drive pin 86 located at the upper end thereof. When the mortise unit 82 is installed into the door 42 with the driverail 46 previously installed, the drive pin 86 of the mortise unit 82 will be inserted through the aperture 80 in the driverail 46. Thus, the mortise unit 82 will operate the driverail 46 to reciprocate the shootbolt 54.

Although it is not shown in the drawings, the driverail 48 is configured similarly to the driverail 46 with an aperture at its proximal end. The mortise unit 82 has a reciprocally operable drive arm extending from its bottom side which has an inwardly extending drive pin that engages the aperture of the driverail 48 to operate it simultaneously with the driverail 46. Thus, the shootbolt 76 is operated simultaneously with the shootbolt 54.

In an embodiment configured as a 3 or 4 bolt multi-point lock, a bolt 128 is pivotably coupled to the driverail 46. The bolt 128 is located in the lateral edge of the door or window between the mortise unit 82 and the shootbolt 54. When the shootbolt 54 is in the retracted position, the bolt 128 is also in a retracted position within the U-shaped channel 30. When the shootbolt 54 is moved to an extended position by the mortise unit 82, the bolt 128 is also moved to an extended position to engage a lateral portion of a door frame.

In a typical configuration, as the driverail 46 moves toward the shootbolt 54, the bolt 128 swings out of the U-shaped channel 30 about a pivot coupling to the driverail 46. Likewise as the driverail 46 moves away from the shootbolt 54 (but still coupled to the shootbolt 54), the bolt 128 swings back to the U-shaped channel 30 about the pivot coupling into the retracted position. It should be understood that a second bolt 128, in some configurations, is pivotably coupled to the driverail 48 similarly to the driverail 46 and is located between the mortise unit 82 and the shootbolt 76. In such embodiment, the two shootbolts 54, 76 and the two bolts 128 operate simultaneously with the mortise unit 82.

Referring next to FIG. 11, a mounting plate 92 is shown located at the top of the door 42 with four apertures 94, 96, 98, and 100 located therein. The mounting plate 92 is retained in place with four screws (not shown) which extend through the apertures 94, 96, 98, and 100 in the mounting plate 92 into the top edge of the door 42.

Figure 12:
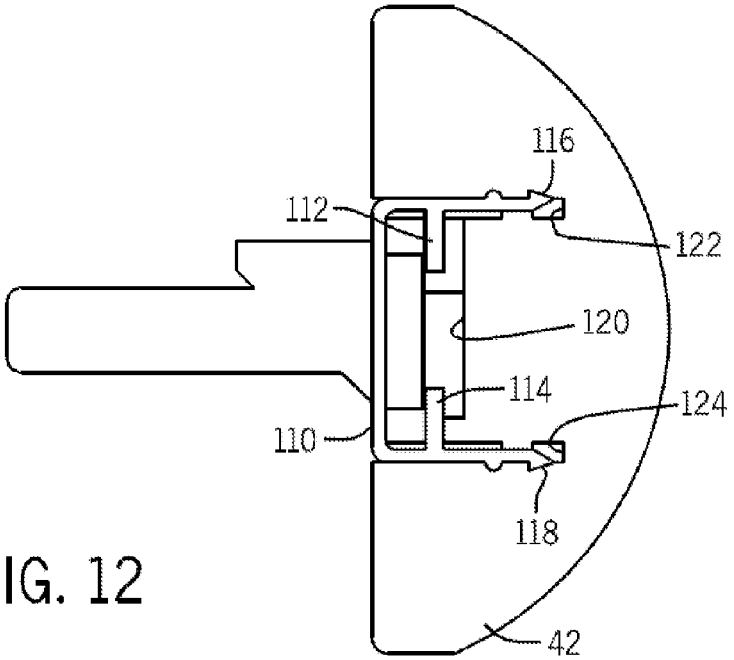
FIG. 12 is a top plan view of the top edge of a portion of the door with a self-installing U-shaped channel and shootbolt actuating driverail mounted therein.

Referring finally to FIG. 12, an alternate embodiment U-shaped channel 110 is illustrated which has a single pair of inwardly-extending flanges 112 and 114 respectively located on the legs of the U-shaped channel 110 spaced away from the bottom of the "U." The driverail 46 is slidably installed in the U-shaped channel 110 intermediate the pair of inwardly-extending flanges 112 and 114 and the bottom of the "U." The tops of the legs of the U-shaped channel 110 have barbed edges indicated generally by the reference numerals 116 and 118.

The U-shaped channel 110 is installed into a groove 120 having deeper recesses along the sides thereof as indicated generally by the reference numerals 122 and 124. The barbed edges 116 and 118 of the U-shaped channel 110 are pressed into the deeper recesses 122 and 124, respectively, to secure the U-shaped channel 110 in the groove 120.

It should be understood that the multi-point lock disclosed herein provide configurations used with a door composed of wood, hollow-frame structure, metal or composite engineered material. The groove 40 or 120 can be formed, for example, by molding, as the non-wooden door is fabricated.

The multi-point lock of the present invention accommodates a cap or filler for visually concealing the hardware, it allows for cost-effective transmission of mechanical force by minimizing fasteners needed to drive bolts, it simplifying door construction, it reduces the number of fasteners needed to install the multi-point lock, and it allows for substantial reinforcement of the door or window to the frame for better weather sealing.

Thus, it will be appreciated that the multi-point lock of the present invention may be used for manipulating the position of a side hinged door or window including French door/window applications. In general, the multi-point lock of the present invention finds application with two types of locks. The first is an "Active" mortise lock case featuring a latch, dead bolt, and primary and secondary inputs for operating the device, an upper and lower drive rail, an upper and lower shootbolt, an upper and lower shootbolt guide, and strike plates. The second is an "Inactive" mortise lock case featuring at least one input for operating the device, an upper and lower drive rail; an upper and lower shootbolt, an upper and lower shootbolt guide, and strike plates. User interfaces with a patio door handle may be set to operate the locks. The locks provide capability to engage shootbolts into the head and the sill and also to engage an Active mortise panel with an Inactive mortise panel. The locks provide capability to engage bolts that extend and retract from the lateral edge of a door in conjunction with bolts operative from the top and bottom of a door.

For purposes of this disclosure, the term "coupled" means the joining of two components (electrical or mechanical) directly or indirectly to one another. Such joining may be stationary in nature or moveable in nature. Such joining may be achieved with the two components (electrical or mechanical) and any additional intermediate members being integrally formed as a single unitary body with one another or the two components and any additional member being attached to one another. Such adjoining may be permanent in nature or alternatively be removable or releasable in nature.

It may therefore be appreciated from the above detailed description of the preferred embodiment of the present invention that it teaches a multi-point lock having a shootbolt actuating mechanism that is easy to install in a door, and which does not require a complex installation process. The multi-point lock of the present invention has a shootbolt and a shootbolt actuating mechanism that are installable in a door using only relative simple tools to prepare the door for installation of the shootbolt and its shootbolt actuating mechanism. The shootbolt and its shootbolt actuating mechanism are of relatively simple mechanical construction to further facilitate their installation into a door.

The multi-point lock and/or the mortise unit of the present invention is removable from a door without requiring the door to be removed. It is of modular construction to facilitate both the installation as well as the removal of the multi-point lock of the present invention. The multi-point lock of the present invention is adaptable to fit doors of any size, with a single kit accommodating doors of different sizes.

The multi-point lock of the present invention is of a construction which is both durable and long lasting, and which will require little or no maintenance to be provided by the user throughout its operating lifetime. The multi-point lock of the present invention is also of inexpensive construction to enhance its market appeal and to thereby afford it the broadest possible market. Finally, all of the aforesaid advantages are achieved by the multi-point lock of the present invention without incurring any substantial relative disadvantage.

Although the foregoing description of the present invention has been shown and described with reference to particular embodiments and applications thereof, it has been presented for purposes of illustration and description and is not intended to be exhaustive or to limit the invention to the particular embodiments and applications disclosed. It will be apparent to those having ordinary skill in the art that a number of changes, modifications, variations, or alterations to the multi-point lock as described herein may be made, none of which depart from the spirit or scope of the present invention. The particular embodiments and applications were chosen and described to provide the best illustration of the principles of the multi-point lock and its practical application to thereby enable one of ordinary skill in the art to utilize the multi-point lock in various embodiments and with various modifications as are suited to the particular use contemplated. All such changes, modifications, variations, and alterations should therefore be seen as being within the scope of the present invention as determined by the appended claims when interpreted in accordance with the breadth to which they are fairly, legally, and equitably entitled.

While the current application recites particular combinations of features in the claims appended hereto, various embodiments of the invention relate to any combination of any of the features described herein whether or not such combination is currently claimed, and any such combination of features may be claimed in this or future applications. Any of the features, elements, or components of any of the exemplary embodiments discussed above may be claimed alone or in combination with any of the features, elements, or components of any of the other embodiments discussed above.

What is claimed is:

1. A multi-point lock comprising:

at least one shootbolt for mounting in one of a top and bottom edge of a door;

at least one groove defined in a lateral edge of the door;

at least one driverail having proximal and distal opposite ends, said driverail being configured for installation into said groove in a vertically slidable manner, said distal end of said driverail being engageable with said shootbolt to drive said shootbolt between a retracted position and an extended position;

an engagement element located in said driverail adjacent said proximal end thereof;

a mortise unit configured for installation into the lateral edge of the door, said mortise unit having a driving element associated therewith that is moveable between unlocked and locked positions, said driving element engaging said engagement element in said driverail when said mortise unit is installed into the lateral edge of the door after said driverail has been installed into said groove, the mortise unit defines an orifice through the unit, the orifice is configured to slidingly receive an input hub and allow selective lateral movement of the input hub within the orifice; and a cylinder assembly, comprising a cylinder having a cylinder tail piece at one end with a plug-face at another end, and an underplate housing, the underplate housing is configured to receive the cylinder and align the cylinder in the orifice with the plug-face substantially flush with a backplate in a handle set, wherein the position of the cylinder is facilitated by the input hub sliding within the mortise unit;

wherein said shootbolt is driven from said retracted position to said extended position when said driving element of said mortise unit is moved from said unlocked position to said locked position.

2. The multi-point lock of claim 1, wherein the mortise is one of an active mortise and an inactive mortise;

wherein the underplate housing is configured to be located between the backplate and the door; and wherein the underplate housing is located between the plug-face and the mortise unit.

3. The multi-point lock of claim 1, further comprising:

at least one additional shootbolt for mounting in one of a top and bottom edge of the door;

at least one additional groove defined in the lateral edge of the door;

at least one additional driverail having proximal and distal opposite ends, said additional driverail being configured for installation into said additional groove in a vertically slidable manner, said distal end of said driverail being engageable with said additional shootbolt to drive said shootbolt between a retracted position and an extended position; and an additional engagement element located in said additional driverail adjacent said proximal end thereof;

wherein the mortise includes an additional driving element associated therewith that is moveable between unlocked and locked positions, said additional driving element engaging said additional engagement element in said additional driverail wherein both shootbolts are driven from said retracted position to said extended position when both driving elements of said mortise unit is moved from said unlocked position to said locked position.

4. The multi-point lock of claim 1, wherein the plug-face of the cylinder defines a key-lock opening.

5. The multi-point lock of claim 1, wherein the one shootbolt and one driverail are configured as a single member and the additional shootbolt and additional driverail are configured as a single member.

6. A multi-point lock including a plurality of drive rails and associated bolts, with the multi-point lock configured for installation in a door, with a cylinder plug-face disposed substantially flush with a back plate of a handle set associated with the multi-point lock, the multi-point lock comprising:

a mortise unit configured for installation into the lateral edge of the door, said mortise unit having a driving element associated therewith that is moveable between unlocked and locked positions, said driving element engaging at least one driverail when said mortise unit is installed into the lateral edge of the door after said driverail has been installed into the door, the mortise unit defines an orifice through the unit, the orifice is configured to slidingly receive an input hub and allow selective lateral movement of the input hub within the orifice; and a cylinder assembly, comprising a cylinder having a cylinder tail piece at one end with a plug-face at another end, and an underplate housing, the underplate housing is configured to receive the cylinder and align the cylinder in the orifice with the cylinder plug-face substantially flush with a backplate in the handle set for a range of door thicknesses, wherein the position of the cylinder in the orifice is facilitated by the input hub sliding within the mortise unit, and wherein said bolt is driven from a retracted position to an extended position when said driving element of said mortise unit is moved from said unlocked position to said locked position.

7. The multi-point lock of claim 6, wherein the mortise is one of an active mortise and an inactive mortise.

8. The multi-point lock of claim 6, wherein the plug-face of the cylinder defines a key-lock opening; and wherein the underplate housing is configured to be located under the backplate.

9. The multi-point lock of claim 6, wherein each of the bolt and associated driverail are configured as a single member.

10. A multi-point lock comprising:

a first shootbolt for mounting in a top edge of a door;

a first U-shaped channel adapted for installation into a groove defined in a lateral edge of the door;

a first driverail having proximal and distal opposite ends, said first driverail being configured for installation into said first U-shaped channel in a vertically slidable manner, said distal end of said first driverail being engageable with said first shootbolt to drive said first shootbolt between a retracted position and an extended position;

a first engagement element located in said first driverail adjacent said proximal end thereof;

a second shootbolt for mounting in a bottom edge of a door;

a second U-shaped channel adapted for installation into the groove in the lateral edge of the door;

a second driverail having proximal and distal opposite ends, said second driverail being adapted for installation into said second U-shaped channel in a vertically slidable manner, said distal end of said second driverail being engageable with said second shootbolt to drive said second shootbolt between a retracted position and an extended position;

a second engagement element located in said second driverail adjacent said proximal end thereof;

a mortise unit configured for installation into the lateral edge of the door, said mortise unit having a driving element associated therewith that is moveable between unlocked and locked positions, said driving element engaging said engagement element in said driverail when said mortise unit is installed into the lateral edge of the door after said driverail has been installed into said groove, the mortise unit defines an orifice through the unit, the orifice is configured to slidingly receive an input hub and allow selective lateral movement of the input hub within the orifice; and a cylinder assembly, comprising a cylinder having a cylinder tail piece at one end with a plug-face at another end, and an underplate housing wherein the underplate housing is configured to receive the cylinder and align the cylinder in the orifice with the plug-face substantially flush with a backplate in a handle set, wherein the position of the cylinder is facilitated by the input hub sliding within the mortise unit;

wherein said shootbolt is driven from said retracted position to said extended position when said driving element of said mortise unit is moved from said unlocked position to said locked position.

11. The multi-point lock of claim 10, wherein the mortise is one of an active mortise and an inactive mortise.

12. The multi-point lock of claim 10, wherein the plug-face of the cylinder defines a key-lock opening.

13. The multi-point lock of claim 10, wherein the first shootbolt and first driverail are a single member and the second shootbolt and seconded driverail are a single member.

14. A method of installing a multi-point lock into a door, comprising:

mounting at least one shootbolt in one of a top and bottom edge of the door;

installing at least one driverail into a groove defined in a lateral edge of the door, the driverail having proximal and distal opposite ends in said groove in a vertically slidable manner, said distal end of said driverail coupling with said shootbolt to drive said shootbolt between a retracted position and an extended position, said driverail having an engagement element located in said proximal end thereof;

installing a mortise unit into the lateral edge of the door after said driverail have been installed into said groove, said mortise unit having a driving element associated therewith that is moveable between unlocked and locked positions, said driving element engaging said engagement element in said driverail, the mortise unit defines an orifice through the unit, the orifice is configured to slidingly receive an input hub and allow selective lateral movement of the input hub within the orifice; and installing a cylinder assembly into the mortise unit, the cylinder assembly comprising a cylinder having a cylinder tail piece at one end with a plug-face at another end, and an underplate housing wherein the underplate housing is configured to receive the cylinder and align the cylinder in the orifice with the plug-face substantially flush with a backplate in a handle set, wherein the position of the cylinder is facilitated by the input hub sliding within the mortise unit;

wherein said shootbolt is driven from said retracted position to said extended position when said driving element of said mortise unit is moved from said unlocked position to said locked position.

15. The method of installing a multi-point lock into a door of claim 14, wherein the mortise is one of an active mortise and an inactive mortise.

16. The method of installing a multi-point lock into a door of claim 14, wherein the plug-face of the cylinder defines a key-lock opening.

17. The method of installing a multi-point lock into a door of claim 14, wherein the shootbolt and driverail are a single member.

18. The multi-point lock of claim 1, wherein the backplate is configured to be directly mounted to the door.

19. The multi-point lock of claim 6, wherein the backplate is configured to be directly mounted to the door.

20. The multi-point lock of claim 10, wherein the backplate is configured to be directly mounted to the door.

21. The method of installing a multi-point lock into a door of claim 14, wherein the backplate is configured to be directly mounted to the door.

* * * * *